US006964494B2

(12) United States Patent
Niven

(10) Patent No.: US 6,964,494 B2
(45) Date of Patent: Nov. 15, 2005

(54) SAFETY/WARNING DEVICE

(75) Inventor: Rex Carswell George Niven, Eltham (AU)

(73) Assignee: Eflare Corporation Pty LTD, (AU)

( * ) Notice: Subject to any disclaimer, the term of this patent is extended or adjusted under 35 U.S.C. 154(b) by 0 days.

(21) Appl. No.: 10/071,163

(22) Filed: Feb. 8, 2002

(65) Prior Publication Data

US 2003/0151518 A1 Aug. 14, 2003

(51) Int. Cl.[7] ..... F21L 4/00
(52) U.S. Cl. ..... 362/205; 362/186; 362/337
(58) Field of Search ..... 362/186, 202, 362/205, 337

(56) References Cited

U.S. PATENT DOCUMENTS

| | | | | |
|---|---|---|---|---|
| 5,230,560 | A * | 7/1993 | Lyons | 362/297 |
| D389,595 | S | 1/1998 | Hunter | |
| D402,383 | S | 12/1998 | Hunter | |
| D412,132 | S | 7/1999 | Aylward et al. | |
| 6,045,236 | A * | 4/2000 | Cheng et al. | 362/188 |
| 6,074,072 | A * | 6/2000 | Parsons et al. | 362/202 |
| 6,086,220 | A * | 7/2000 | Lash et al. | 362/244 |
| 6,099,148 | A * | 8/2000 | Northrup et al. | 362/336 |
| D456,411 | S | 4/2002 | Kourushi | |
| 6,428,179 | B1 * | 8/2002 | Saffron et al. | 362/118 |
| 6,511,203 | B1 * | 1/2003 | Winther | 362/202 |
| 6,523,969 | B2 * | 2/2003 | Yang et al. | 362/118 |
| 2001/0012204 | A1 * | 8/2001 | Sharrah et al. | 362/184 |
| 2002/0114154 | A1 * | 8/2002 | Galli | 362/205 |
| 2003/0151518 | A1 | 8/2003 | Niven | |

FOREIGN PATENT DOCUMENTS

| | | |
|---|---|---|
| AU | DES. 122930 | 5/1994 |
| AU | DES. 122931 | 5/1994 |
| AU | WO 95/31352 | 11/1995 |
| AU | DES. 127931 | 12/1995 |
| AU | DES. 134908 | 12/1996 |
| AU | DES. 134909 | 12/1996 |
| AU | DES. 141586 | 10/1998 |
| GB | DES. 2043443 | 3/1995 |

OTHER PUBLICATIONS

U.S. Appl. No. 08/737,493, Filed on Feb. 5, 1997, Aylward et al.
Singapore Appl. No. SG 200100309-4, Filed on Jan. 22, 2001, Singapore.
Australia Appl. No. AU 5,397/2002, Filed on Feb. 4, 2002, Australia.

* cited by examiner

*Primary Examiner*—Sandra O'Shea
*Assistant Examiner*—Peggy A. Neils
(74) *Attorney, Agent, or Firm*—Greenberg Traurig, LLP; Charles Berman, Esq.; Pablo E. Tapia, Esq.

(57) ABSTRACT

A safety/warning device having a body adapted to releasably receive therein at least one source of electrical energy, the body having an open upper end in which is received a grommet, the grommet having first engaging means for engaging with second engaging means of the body to ensure correct location of the grommet relative to the body; the grommet having internal engagement means for receiving therein a light source to ensure the light source is accurately located relative to a lens which sealingly engages over and closes the open upper end; wherein the light source is at least one light emitting diode mounted on a circuit board.

7 Claims, 4 Drawing Sheets

SAFETY/WARNING DEVICE

REFERENCE TO RELATED APPLICATIONS

The present invention is an improvement in the devices shown in our Australian patent 706664 (24403/951 WO 95/31352); international application PCT/AU99/00904; Singapore patent 35530; and European application 95918464-9 (collectively our "Earlier Patents"), the contents of which are hereby incorporated by reference.

FIELD OF THE INVENTION

This invention relates to a hazard/safety warning device for indicating the presence of a hazard and/or the location of a person or object particularly, though not exclusively, in abnormal situations.

BACKGROUND TO THE INVENTION

The devices shown in our Earlier Patents use incandescent globes. The heat generated by such globes makes them unsuitable for use in a near flamable material. They are also prone to failure when subjected to a physical shock as in being dropped or run over by a car.

It is therefore a principal object of the present invention to provide a device such as those shown in our Earlier Patents, but which can be used in or near flamable materials.

A further object is to provide such a device with a light source which has a greater chance of withstanding physical shock.

SUMMARY OF THE INVENTION

With the above and other objects in mind the present invention provides a safety/warning device having a body adapted to releasably receive therein at least one source of electrical energy, the body having an open upper end in which is received a grommet, the grommet having first engaging means for engaging with second engaging means of the body to ensure correct location of the grommet relative to the body; the grommet having internal engagement means for receiving therein a light source to ensure the light source is accurately located relative to a lens which sealingly engages over and closes the open upper end.

Preferably, the light source is at least one light emitting diode mounted on a circuit board, and more preferably the circuit board includes a low-battery-warning indicator.

It may also include a first contact to contact a first terminal of the source of electrical energy; and a second contact to contact a second terminal of the source of electrical energy.

The second terminal of the source of electrical energy may have a contact strip to contact the second contact. There may be a switch mounted on the circuit board adapted to be contacted by a finger on the lens for the switching on and off of the device upon rotation of the lens. The switch may include an over-center contact. Alternatively, there may be a switch means to switch the device on and off, the switch means being substantially shock proof. Preferably, the switch means includes an over-center contact.

The light source may be located within the lens such that the at least one light emitting diode is at a height relative to the lens to give a relatively bright band of light in the horizontal direction through a first portion of the lens. The first portion may have a relatively smooth and convex outer surface and may be located between a lower portion and a shoulder portion, the lower portion and shoulder portions having Fresnel lens characteristics to minimise light transmitted therethrough.

In another form, the present invention provides a safety/warning device having a light source accurately mounted within a lens at a height relative to the lens corresponding to a first portion of the lens, the first portion having a relatively smooth and flat inner surface; and a relatively smooth and convex counter surface; the first portion being located between a lower portion and a shoulder portion, the lower portion and the shoulder portion having Fresnel lens characteristics to minimise light transmission therethrough.

Preferably, the lens has an upper surface with Fresnel lens characteristics to minimise light transmission therethrough except for a generally vertical, central beam.

Advantageously, the convex outer surface of the first portion of the lens has an apex, and the at least one LED has a center, the center and the apex being substantially horizontally aligned.

Also, there may be a plurality of diffuser elements on the inner surface of the lens.

DESCRIPTION OF THE DRAWINGS

In order that the present invention may be fully understood and be more readily put into practical effect, the shall now be described by way of non-limitative example only a preferred embodiment of the present invention, the description being with reference to the accompanying illustrative drawings in which.

DESCRIPTION OF PREFERRED EMBODIMENTS

Figure 1:
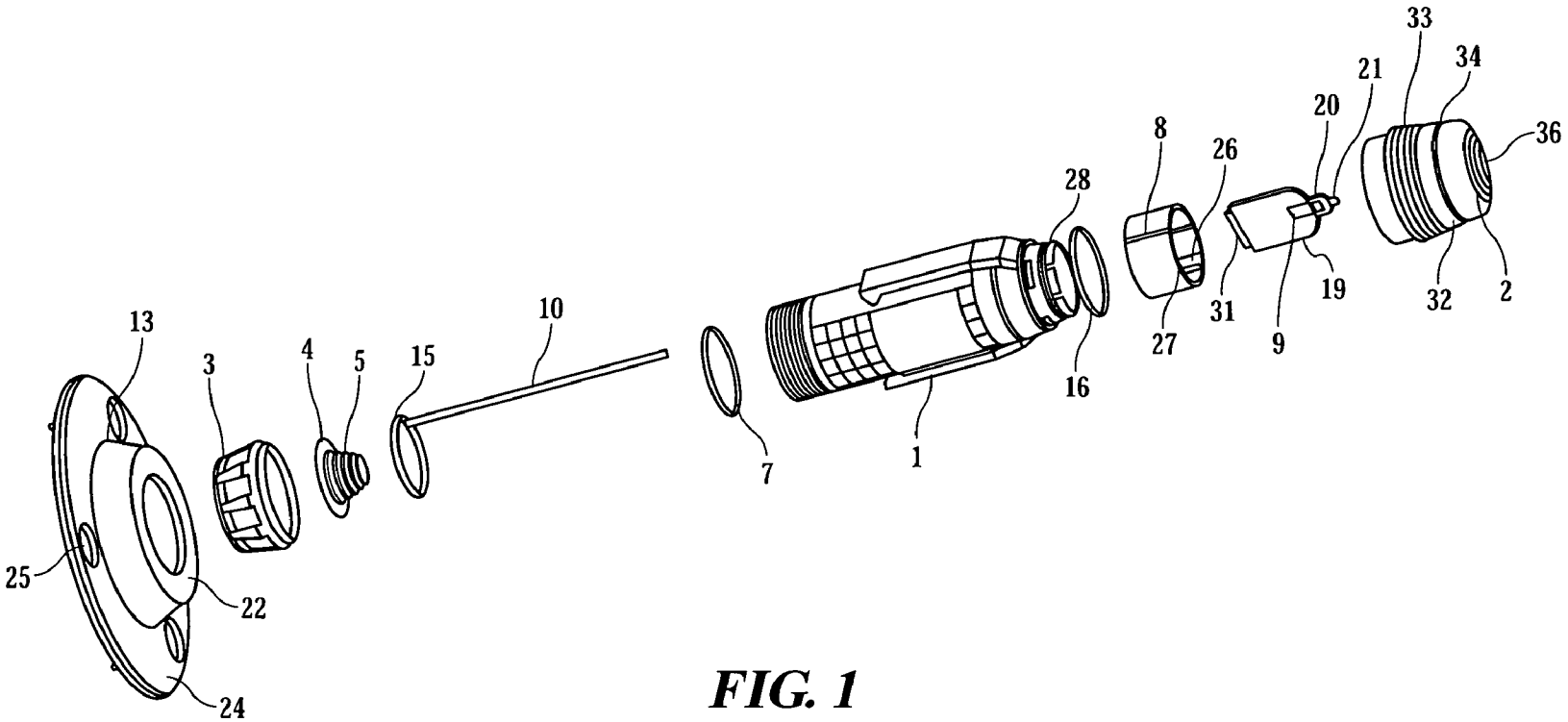
FIG. 1 is a an exploded perspective view of the device.
Figure 2:
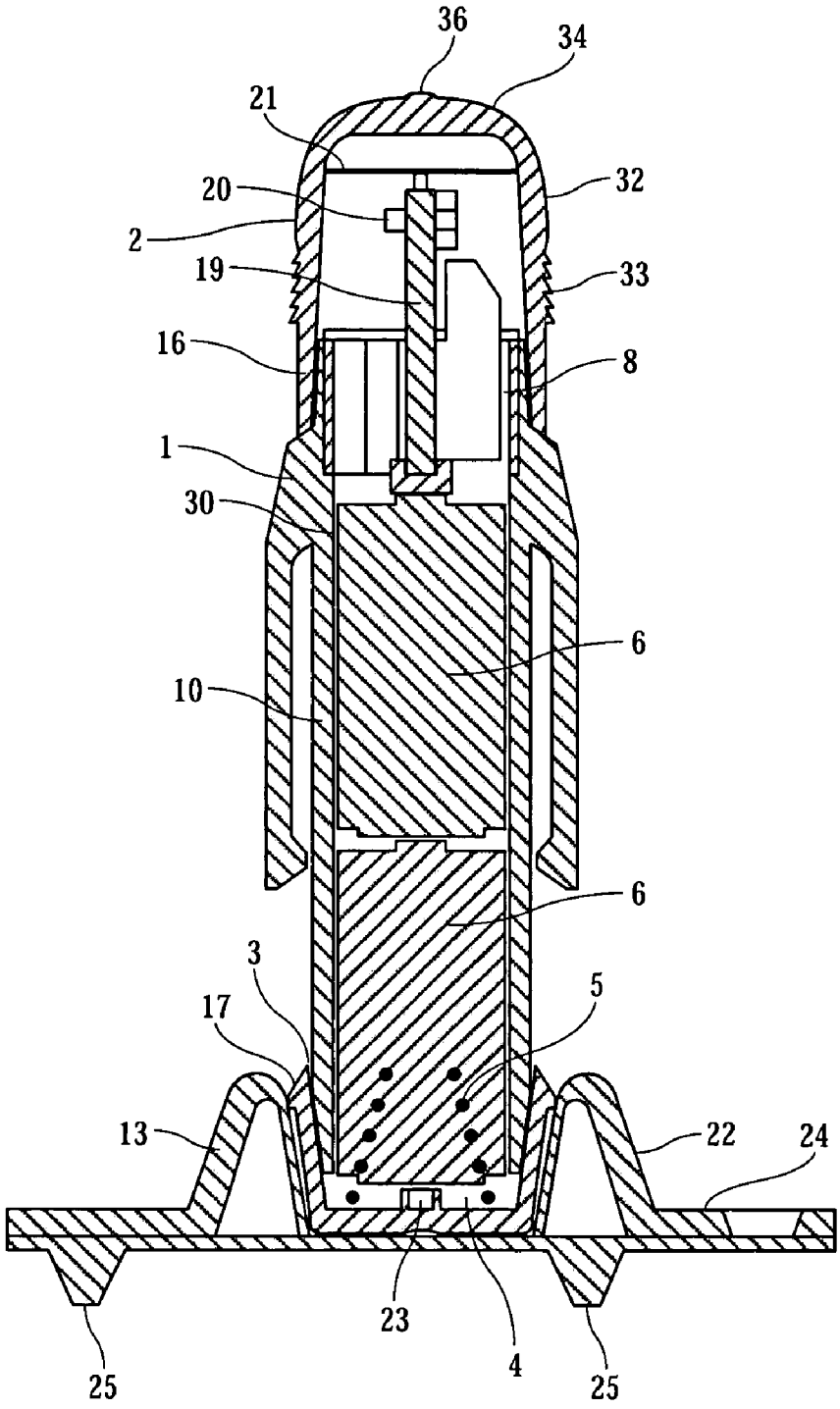
FIG. 2 is a vertical cross-sectional view of the assembled device.
Figure 3:
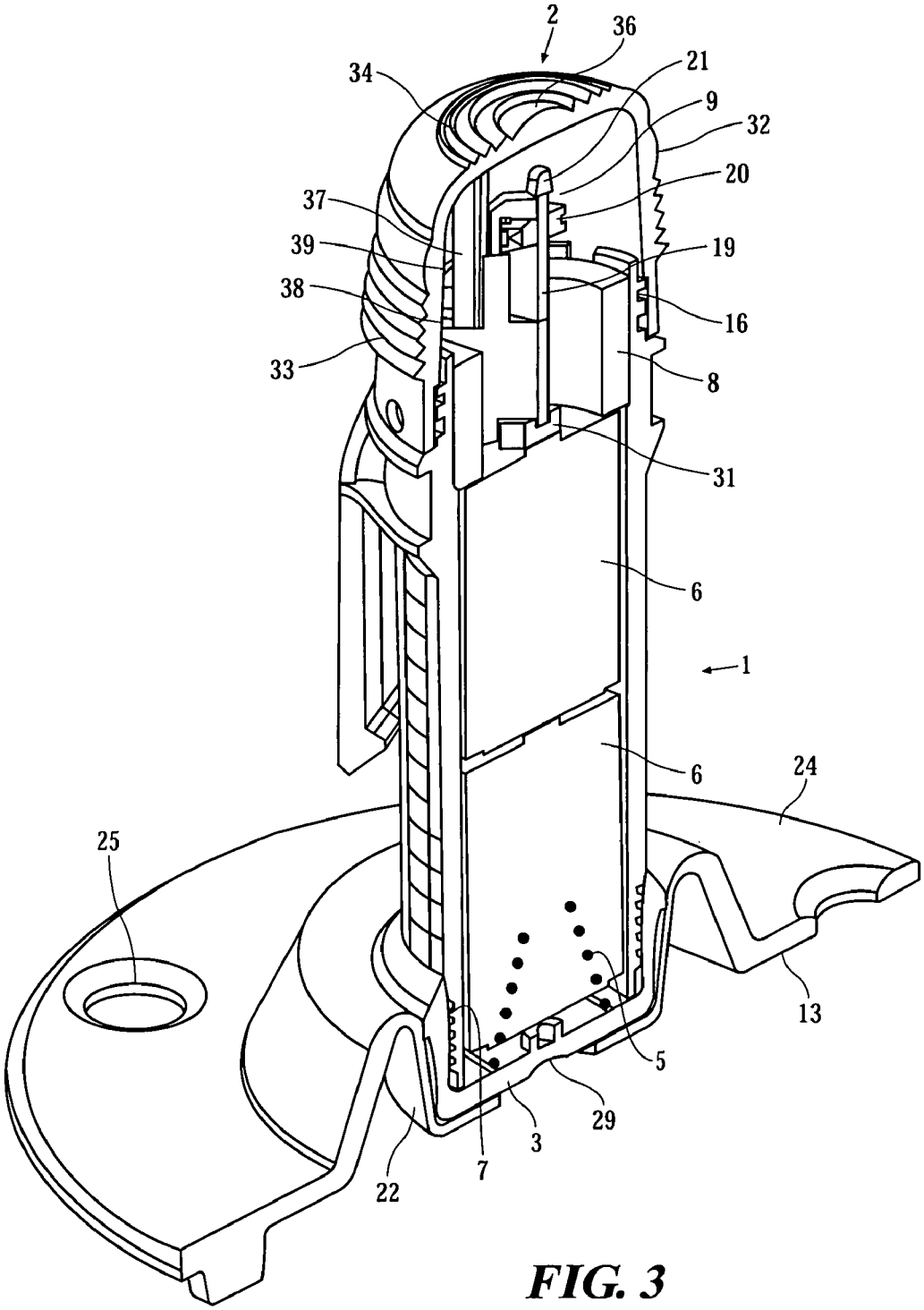
FIG. 3 is a vertical cross-sectional view in perspective of the assembled device.

To refer to FIGS. 1 and 2, there is a device similar to that shown in our Earlier Patents.

The device has a main body 1, which has a shape and form of a hollow opened-ended cylinder. The body 1 is substantially as is described in our Earlier Patents. It is intended to house a source of electricity such as, for example, a plurality (preferably two) batteries 6 (preferably D-cell batteries). The batteries 6 are held in contact with each other by a compression spring 5 which engages under the lower of the two batteries. A battery cap 3 threadingly engages body 1 to hold the batteries 6 and spring 5 in an operational relationship. By having cap 3, batteries 6 can be replaced when and as required. An O-ring 7 is used to provide a seal between cap 3 and body 1. Preferably, the seal is substantially air and water tight.

Cap 3 is adapted to be releasably yet securely held in a base 13. Base 13 has a central portion 22 which is shaped somewhat like an inverted, truncated cone which has a closed lower end 23 having a central opening 29. Extending radially outwardly from central portion 22 is an annular ring 24. The annular ring 24 has a plurality of feet 25 depending therefrom and on which base 13 sits. In the present instance there are three feet 25, although there may be any suitable number or form of feet 25.

As its upper end, body 1 receives therein a grommet 8 in a relatively tight fit. Grommet 8 is fully contained within body 1 when assembled therewith. Grommet 8 is in the form of a hollow cylinder having internal grooves 26 extending longitudinally on its inside wall. One or more external pins 27 may be provided, each of which cooperates with an internal groove 28 of body 1 to ensure that grommet 8 is correctly oriented and axially located.

Grommet 8 holds an illumination device 9 in the grooves 26. In the present instance, the illumination device is at least one high-output light emitting diode ("LED") 20 mounted near the upper end of a circuit board 19 which contains all necessary electrical and similar devices (not shown) to control the LED. At its lower end the circuit board 19 has contacts 31 to contact the positive terminal of the upper battery 6, and to contact the negative terminal of battery 6 via a contact strip 10 physically and electrically connected to a lower contact ring 15. Ring contacts a disc 4 on which spring 5 is mounted. By having spring 5, disc 4, ring 15 and strip 10 all electrically conductive and electrically conductively joined, electrical current can flow to LED 20. If desired, a low-battery-life indicator LED 21 may be provided at the top of circuit board 19. Strip 10 may be located in a longitudinal groove 30 in body 1, if desired.

Figure 4:
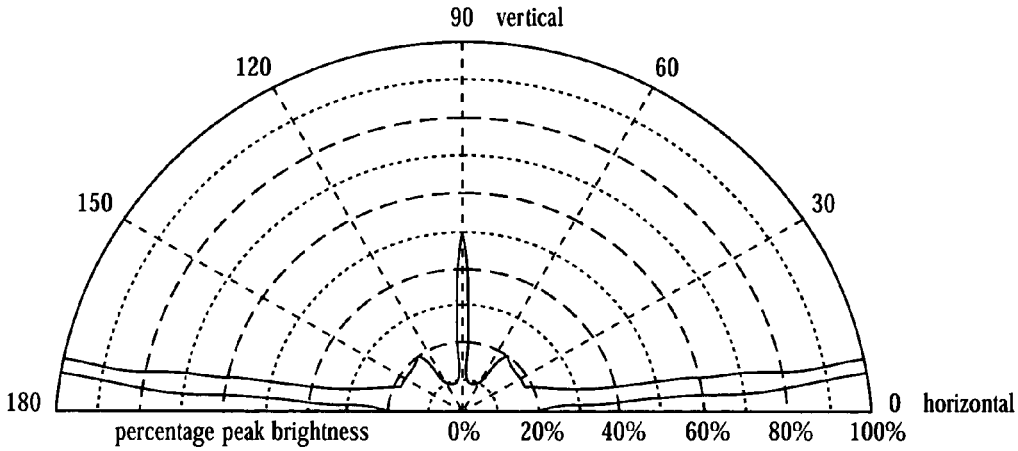
FIG. 4 is a plot of luminous intensity 1% off peak vertical intensity.

The device has a transparent lens 2 which encloses the upper end of body 1. The lens 2 is intended to primarily provide a bright band of light in the horizontal direction (see FIG. 4). Lens 2 has an 0-ring 16 to provide a substantially water and air tight seal with body 1.

Depending from the top of lens 2 is a finger 37, which is eccentric of the lens 2. The finger 37 has a vertical extent such that upon lens 2 being rotated about its longitudinal axis, finger 37 will contact a micro-switch 38 mounted on circuit board 19 to be able to switch the device ON and Off, The contact between finger 37 and the micro-switch 8 may involve an over-center or cam action to provide a postive and relatively shock-proof engagement.

The LED or LEDs 20 are located relative to the lens 2 at a height such that they are aligned with a portion 32 having a relatively smooth and convex outer surface which is intended to focus the light output in the horizontal direction. Preferably, the center of the LED or LEDs is substantially horizontally aligned with the apex of the outer surface of portion 32. Portion 32 is between lower portion 33 and shoulder portion 34. The portions 33 and 34 have Fresnel lens characteristics on the outer surface thereof to reduce light transmission downwardly, and through the shoulder portion 34 of lens 2, respectively. Therefore, the main output of LEDs 20 is through portion 32, and is thus horizontal; and axially upwardly through portion 36. This is reflected in the plot of FIG. 4. The lens 2 may have a series of diffuser elements (not shown) on the inner surface to assist with internal reflection and thus to assist the lens 2 to be seen as a "block" of light from a distance. The inner surface of lens 2 is generally smooth, and at portion 39 (which extends completely around the inner surface of lens 2 in a band of constant height) is relatively flat. This assists in providing a "block" of light in the horizontal direction, a vertical beam of light, and minimal light between the two Whilst there has been described in the foregoing description a preferred embodiment of the present invention, it will be understood by those skilled in the technology that many variations or modifications in details of design or construction may be made without departing from the present invention.

What is claimed is:

1. A safety/warning device having a body adapted to releasably receive therein at least one portable source of electrical energy, the body having an open upper end in which is received a grommet, the grommet having first engaging means for engaging with second engaging means of the body to ensure correct location of the grommet relative to the body; the grommet having internal engagement means for receiving therein at least one light emitting diode mounted on a circuit board to ensure the at least one light emitting diode is accurately located relative to a lens which sealingly engages over and closes the open upper end;

the circuit board including a first contact to contact a first terminal of the portable source of electrical energy, and a second contact to contact a second terminal of the portable source of electrical energy;

the second terminal of the portable source of electrical energy having a contact strip to contact the second contact;

a switch mounted on the circuit board adapted to be contacted by at least one finger on the lens to switch the device on and off, the switch being substantially shock proof, the switch including an over-center contact; and wherein the at least one light emitting diode is at a height relative to the lens to give a relatively bright band of light in the horizontal direction through a first portion of the lens, the first portion having relatively smooth and convex outer surface.

2. A safety/warning device as claimed in claim 1, wherein the first portion has a relatively smooth and flat inner surface, and is located between a lower portion and a shoulder portion, the lower portion and shoulder portions having Fresnel lens characteristics to minimize light transmitted therethrough.

3. A safety/warning device having at least one light emitting diode mounted on a circuit board accurately mounted within a lens at a height relative to the lens corresponding to a first portion of the lens;

the first portion having a relatively smooth and flat inner surface, and relatively smooth and convex outer surface;

the first portion being located between a lower portion and a shoulder portion, the lower portion and the shoulder portion having Fresnel lens characteristics to minimize light transmission therethrough;

the circuit board including a first contact to contact a first terminal of a portable source of electrical energy, and a second contact to contact a second terminal of the portable source of electrical energy;

the second terminal of the portable source of electrical energy having a contact strip to contact the second contact; and a switch mounted on the circuit board adapted to be contacted by at least one finger on the lens to switch the device on and off, the switch being substantially shock proof, the switch including an over-center contact.

4. A safety/warning device as claimed in claim 3, wherein the lens has an upper surface with Fresnel lens characteristics to minimize light transmission therethrough except for a generally vertical, central beam.

5. A safety/warning device as claimed in claim 3, wherein the convex outer surface of the first portion of the lens has an apex, and the at least one light emitting diode has a center, the at least one center and the apex being substantially horizontally aligned.

6. A safety/warning device as claimed in claim 5, wherein there is a plurality of diffuser elements on the inner surface of the lens.

7. A safety/warning device as claimed in claim 3, wherein the lens has an upper surface with Fresnel lens characteristics to minimize light transmission therethrough except for a generally vertical, central beam.

* * * * *